United States Patent [19]

Aida et al.

[11] Patent Number: 4,727,287

[45] Date of Patent: Feb. 23, 1988

[54] GAS DISCHARGE DISPLAY PANEL AND CATHODE USED THEREIN

[75] Inventors: Toshiyuki Aida; Tokuumi Fukazawa, both of Tokyo; Yukio Okamoto, Sagamihara, all of Japan

[73] Assignee: Hitachi, Ltd., Tokyo, Japan

[21] Appl. No.: 870,752

[22] Filed: Jun. 4, 1986

[30] Foreign Application Priority Data

Jun. 10, 1985 [JP] Japan ..... 60-124383

[51] Int. Cl.[4] ..... H01J 61/06

[52] U.S. Cl. ..... 313/582; 313/630; 313/633; 252/509; 427/126.1

[58] Field of Search ..... 313/582, 583, 633, 630, 313/346 R; 252/509, 521; 427/126.1

[56] References Cited

U.S. PATENT DOCUMENTS

| | | | |
|---|---|---|---|
| 4,393,326 | 7/1983 | Kamegaya et al. | 313/630 X |
| 4,554,482 | 11/1985 | Kamegaya et al. | 313/630 X |
| 4,599,076 | 7/1986 | Yokono et al. | 313/630 X |
| 4,600,397 | 7/1986 | Kawakubo et al. | 313/630 X |

*Primary Examiner*—David K. Moore
*Assistant Examiner*—K. Wieder
*Attorney, Agent, or Firm*—Antonelli, Terry & Wands

[57] ABSTRACT

A gas discharge display panel adapted for effecting display by a plurality of gas discharge elements arranged in a matrix has a cathode formed by coating the substrate surface with a (100) preferred film of a rare earth hexaboride such as $LaB_6$. The gas discharge display panel can be driven at relatively low voltage.

13 Claims, 4 Drawing Figures

GAS DISCHARGE DISPLAY PANEL AND CATHODE USED THEREIN

BACKGROUND OF THE INVENTION

The present invention relates to a gas discharge display panel adapted for effecting display by means of a plurality of gas discharge elements arranged in a matrix, and also pertains to a cathode for use in such gas discharge display panel. More particularly, the present invention is concerned with a gas discharge display panel that employs as a cathode material rare earth hexaborides, known as substances which exhibit excellent electron emission characteristics, and also pertains to a cathode for use in such display panel.

This type of gas discharge display panel is disclosed in, e.g., U.S. Pat. No. 4,206,386. One example of conventional gas discharge display panels is shown in FIG. 1. As illustrated, this device has a two-electrode group structure in which a Y-direction electrode group $K_R$, $K_1$, $K_2$, $K_3$, $K_4$, and $K_5$ adapted to operate as cathode elements and an X-direction electrode group $A_1$, $A_2$, $A_3$ and $A_4$ adapted to operate as anode elements are provided between glass plates 1, 2 so that the two electrode groups extend orthogonally to each other. Relatively long and narrow strip-like dielectrics 16 are provided so as to extend parallel to respective anode elements, thereby partitioning the discharge space into individual discharge areas which are vacuum-sealed in a gas that emits light when an electric discharge occurs therein. Discharge dots 15 are respectively formed at intersections between the X-Y electrode elements.

It is strongly demanded to lower the driving voltage in such gas discharge display panel with the view to simplifying the driving circuit, reducing the costs and extending the lifetime of the panel itself.

The application of rare earth hexaborides, represented by $LaB_6$, to cathode elements of a gas discharge display panel has already been practiced in DC discharge display panels, and it has been confirmed that rare earth hexaborides are effective in lowering the discharge maintenance voltage (see the Television Society Technical Report, ED-572 , 1981, or the specification of Japanese Patent Laid-Open No. 62647/1980). However, in these examples, $LaB_6$ film is formed by plasma spray coating or thick film printing, and in these methods a polycrystalline film having irregular crystalline orientation is employed. In addition, $LaB_6$ film may also be formed by electron beam heating (see the specification of Japanese Patent Publication No. 17780/1981). In this case, however, no consideration has heretofore been taken for the preference of a crystal plane of a film deposited by evaporation.

The discharge maintenance voltage in a gas discharge display panel can be made lower as the work function of the cathode thereof is decreased. However, the work function of rare earth hexaborides such as $LaB_6$ greatly differs in accordance with the kind of crystal plane. Accordingly, conventionally employed $LaB_6$ films, which are polycrystalline films or in which no consideration is taken for the preference of the crystal plane, have variations in discharge maintenance voltage and have not satisfactorily lowered the discharge maintenance voltage.

SUMMARY OF THE INVENTION

It is an object of the present invention to provide a gas discharge display panel which employs a rare earth hexaboride and which is very effective in lowering the discharge maintenance voltage, together with a cathode for use in said display panel.

To this end, the present invention provides a gas discharge display panel adapted for effecting display by means of a plurality of gas discharge elements arranged in a matrix, the display panel comprising a cathode formed by coating the substrate surface with a (100) preferred film of a rare earth hexaboride. The present invention also provides a cathode for use in the abovedescribed display panel.

BRIEF DESCRIPTION OF THE DRAWINGS

FIG. 3 shows X-ray diffraction patterns of $LaB_6$ thin film, in which:

FIG. 3(*a*) shows an X-ray diffraction pattern of $LaB_6$ finely-ground powder;

FIG. 3(*b*) shows an X-ray diffraction pattern of an $LaB_6$ thin film having a film thickness of 3,500 Å;

FIG. 3(*c*) shows an X-ray diffraction pattern of an $LaB_6$ thin film having a film thickness of 8,000 Å; and FIG. 3(*d*) shows an X-ray diffraction pattern of an $LaB_6$ thin film having a film thickness of 20,000 Å.

DETAILED DESCRIPTION OF PREFERRED EMBODIMENTS

The work function of rare earth hexaborides greatly differs in accordance with the kind of crystal plane. In the case of, for example, $LaB_6$, its work function is 2.5 eV, 2.7 eV, 2.9 eV and 2.8 eV for (100), (110), (111) and (321) planes, respectively. Thus, the work function of $LaB_6$ is lowest at the (100) plane. The discharge maintenance voltage of a gas discharge display panel can be lowered as the work function of its cathode is lowered. Accordingly, if the cathode surface is coated with a rare earth hexaboride having a (100) plane, it is possible to drive the gas discharge display panel at the lowest driving voltage.

According to the present invention, among the crystal planes of a rare earth hexaboride, the (100) plane, which has the lowest work function, is selected and coated on the cathode substrate surface so as to be exposed, whereby the discharge maintenance voltage of the gas discharge display panel is lowered most efficiently.

Figure 2:
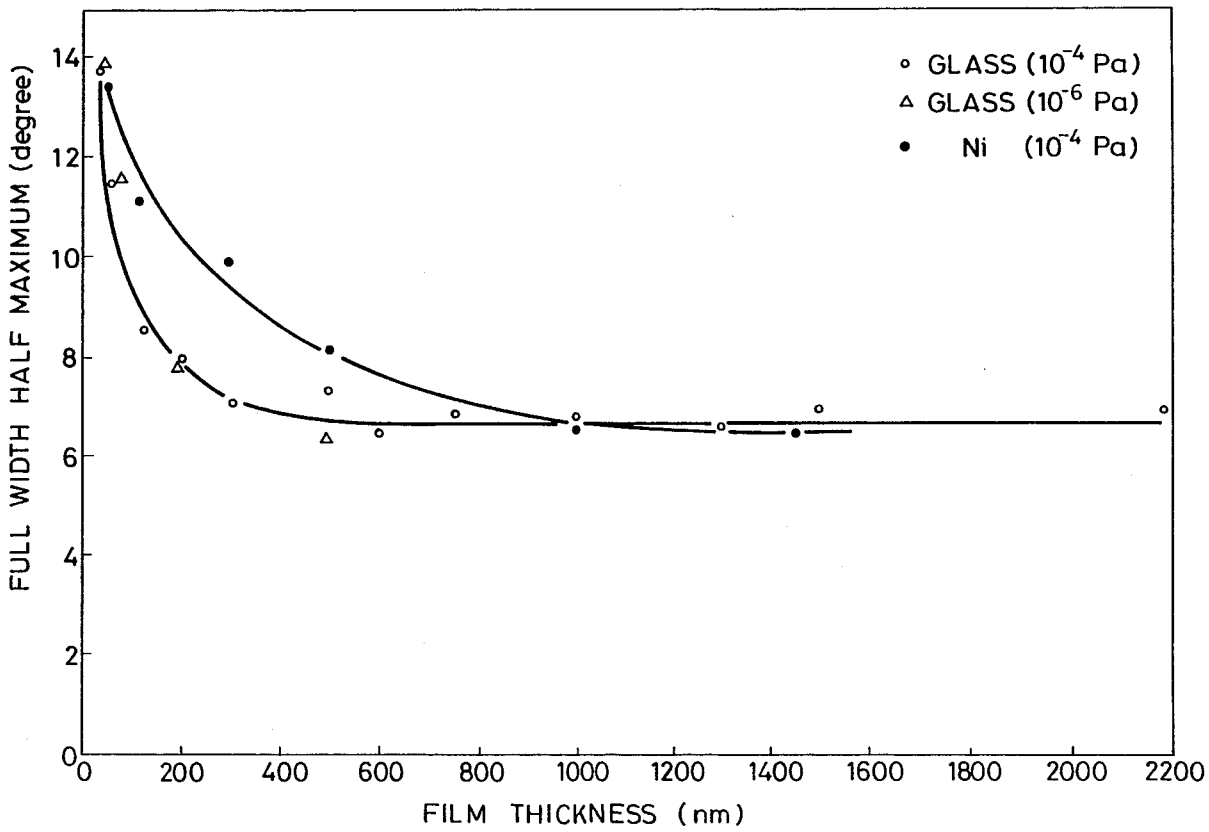
FIG. 2 is a graph showing the relationship between the film thickness of an $LaB_6$ film and the FWHM (Full Width Half Maximum) of (100) diffraction rocking curve.

Methods of obtaining the above-described (100) preferred film of a rare earth hexaboride are not particularly limited, but the electron beam evaporation method is generally preferable. When a rare earth hexaboride thin film is formed by this method, the thin film easily has an amorphous structure when the film is extremely thin. However, when the film thickness is increased to a certain extent, a (100) preferred film can be obtained. It is only necessary for the film thickness at this time to be more than about 5,000 Å, although it depends on various conditions in which the thin film is formed. FIG. 2 shows the effect of the film thickness on FWHM (Full Width Half Maximum) of the (100) diffraction rocking curve of lanthanum hexaboride ($LaB_6$) film. When the film thickness exceeds 5,000 Å, the FWHM decreases, and the preference of the crystal film is improved. Therefore, the film thickness of a rare earth hexaboride film in accordance with the present invention is preferably 5,000 Å or more. Although the upper limit of the film thickness is not particularly restricted, the preferable upper limit is 10 μm from the economical point of view. Accordingly, a preferable film thickness range is from 5,000 521 to 10 μm. Although it has already been mentioned that the rare earth hexaboride film in acocrdance with the present invention is excellent in preference, it is preferable to employ a film whose FWHM of the (100) diffraction rocking curve is 8° or less as shown in FIG. 2.

Examples of the present invention and advantages offered thereby will be described hereinunder in detail.

EXAMPLE 1

Figure 3:
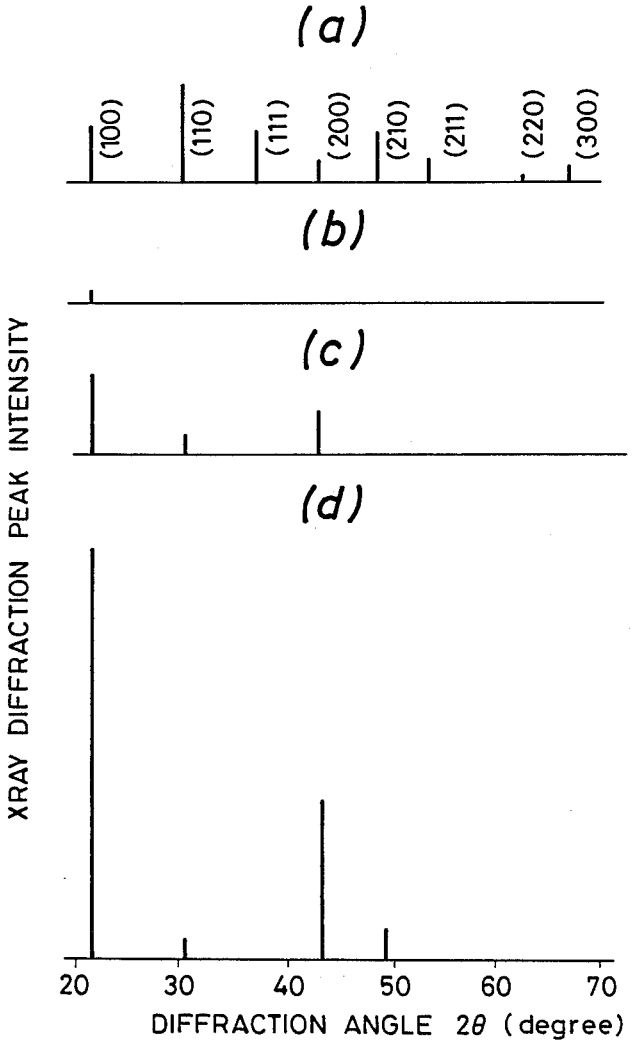

Among the rare earth hexaborides, $LaB_6$ was selected, and an $LaB_6$ thin film was prepared by the electron beam evaporation method. As an evaporation material, a single crystal material grown by an infrared ray heating-floating zone method from a polycrystalline material was employed. As an evaporation substrate, soda glass was employed and heated at 350°. The degree of vacuum at the time of evaporation was $5\times10^{-6}$ Torr. FIG. 3 shows diffraction patterns obtained by subjecting $LaB_6$ thin films having various thicknesses to the X-ray diffraction by characteristic X-rays of CuKα. Diffraction conditions were 40 kV, 30 mA and $1\times10^3$ cps on full scale. FIG. 3(*a*) shows the results of the X-ray diffraction in the case where $LaB_6$ finely-ground powder was employed as a standard sample. Although the strongest peak appeared at (110) plane, the pattern represented well a simple cubic structure of $LaB_6$. FIG. 3(*b*) shows a diffraction pattern in the case of an $LaB_6$ film having a film thickness of 3,500 Å. Although a slight diffraction peak was recognized at the (100) plane, no peak was present at the other planes, and this film generally had an amorphous structure. FIG. 3(*c*) shows a diffraction pattern of an $LaB_6$ film having a film thickness of 8,000 Å. In this case, the diffraction peaks of the (100), (110) and (200) planes were clearly observed. However, the diffraction peak of the (100) plane was stronger than that of the (110) plane, and preference was recognized in which the respective (100) planes of crystallites within the evaporated film extended parallel to the substrate. FIG. 3(*d*) shows a diffraction pattern of an $LaB_6$ film having a film thickness of 20,000 Å. In this case, strong diffraction peaks of (100) and (200) planes were observed, and it has been found that the (100) plane is strongly preferred with respect to the substrate and the crystallizability is also improved. It may be concluded from the above that, when an $LaB_6$ thin film is formed by the electron beam evaporation method, a portion of the film which is deposited in an early stage of evaporation to a thickness of 5,000 Å is easily affected by the glass substrate so as to have an amorphous structure, but as the thickness of the evaporated film increases, it becomes easy for a (100) preferred film of $LaB_6$ to be grown.

No conventional method has succeeded in producing a strong (100) preferred film such as that shown in this example by evaporation (see the specification of Japanese Patent Publication No. 17780/1981). It may be considered that, since the prior art employs an $LaB_6$ sintered material as an evaporation material, the degree of vacuum at the time of evaporation may be unfavorably low, and a relatively large amount of impurities may be included; therefore, conditions are not suitable for producing an $LaB_6$ film of high quality.

EXAMPLE 2

The effectiveness of employing a (100) preferred film of $LaB_6$ as a cathode material has been confirmed by an actual gas discharge display panel.

Figure 1:
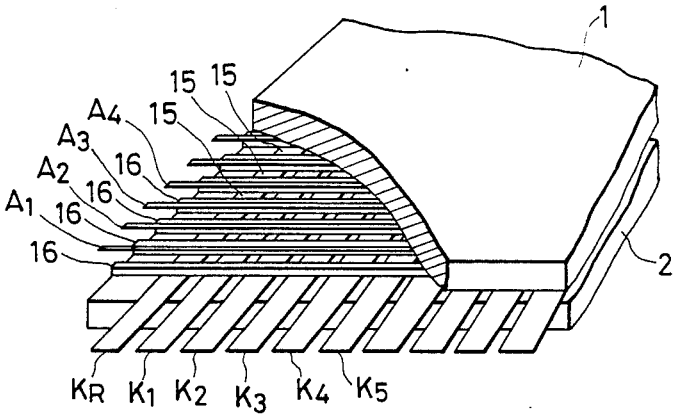
FIG. 1 is a fragmentary perspective view of a gas discharge display panel.
Figure 4:
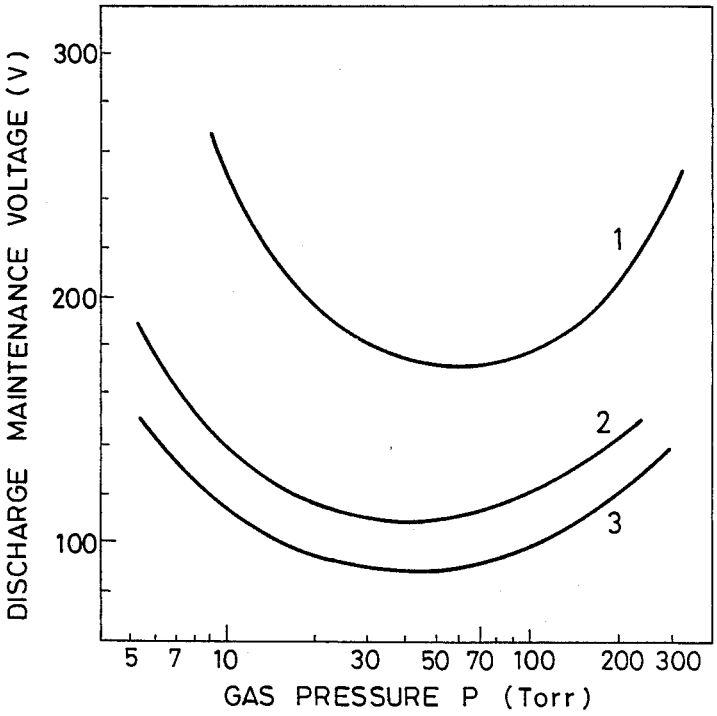
FIG. 4 is a discharge characteristic chart showing the relationship between the discharge maintenance voltage and the gas pressure.

A multiplicity of Ni cathode lines were provided on a soda glass substrate at a pitch of 0.2 mm and a line width of 0.1 mm by thick film printing. An $LaB_6$ film having a thickness of about 10,000 Å was deposited thereon by the electron beam evaporation method under the conditions mentioned in Example 1. The $LaB_6$ film was confirmed that it was a (100) preferred film by means of X-rays as shown in FIG. 3. A multiplicity of Ni anode lines were formed on a transparent soda glass at a pitch of 0.2 mm and a line width of 0.03 mm by thick film printing. Then, the two soda glasses were laid one upon the other in such a manner a vacuum space is formed therebetween in which the cathode and anode lines face and extend orthogonally to each other. Then, Ne-4% Ar gas was introduced into the vacuum space at various gas pressures, and a predetermined voltage was applied to the intersections between the cathode and anode lines to produce a plasma, thereby examining effects of the gas pressure on the discharge maintenance voltage. The results of the experiment is shown as a discharge characteristic curve 3 in the graph of FIG. 4. FIG. 4 also shows the discharge characteristic curve 1 of a conventional Ni cathode - Ni anode structure and the discharge characteristic curve 2 of a polycrystalline $LaB_6$ cathode - Ni anode structure for comparative purposes. The polycrystalline $LaB_6$ cathode lines were formed from $LaB_6$ powder by thick film printing. It may be understood from FIG. 4 that the gas discharge display panel according to the present invention which includes cathode lines coated with a (100) preferred film of $LaB_6$ and Ni anode lines has a discharge maintenance voltage lower than those of the display panels respectively including Ni cathode lines and polycrystalline $LaB_6$ cathode lines. This shows that the (100) plane which has a relatively low work function in the $LaB_6$ crystal effectively acts to lower the discharge maintenance voltage of the gas discharge display panel.

EXAMPLE 3

Other rare earth hexaborides than $LaB_6$, i.e., $CeB_6$, $PrB_6$, $NdB_6$, $SmB_6$ and $GdB_6$ were employed to form evaporated films similar to that described in Example 1. It has been confirmed from experiments that the (100) plane which has a relatively low work function is effective in lowering the discharge maintenance voltage in the gas discharge display panel to substantially the same extent as that of the example shown in FIG. 4.

As will be clear from the above-described examples, it is possible, according to the present invention, to greatly lower the discharge maintenance voltage of a gas discharge display panel by coating the substrate surface with a (100) preferred film of a rare earth hexaboride. Therefore, the present invention can contribute to simplifying the driving circuit, reducing the costs and extending the lifetime of the panel itself. Thus, the present invention is of great industrial value.

What is claimed is:

1. A gas discharge display panel adapted for effecting display by a plurality of gas discharge elements arranged in a matrix, comprising:

cathode elements formed by coating a substrate surface with a film of a rare earth hexaboride, the film having a (100) preferred plane, so as to provide a display panel having a reduced discharge maintenance voltage as compared with that of display panels having nickel or polycrystalline rare earth hexaboride cathodes.

2. A gas discharge display panel according to claim 1, wherein said film has a film thickness within a range from 5,000 Å to 10 μm.

3. A gas discharge display panel according to claim 1, wherein the full width half maximum of said film in terms of the (100) diffraction rocking curve is 8° or less.

4. A gas discharge display panel according to claim 1, wherein said rare earth hexaboride is $LaB_6$.

5. A cathode for use in a gas discharge display panel adapted for effecting display by a plurality of gas discharge elements arranged in a matrix, said cathode comprising:

a film of a rare earth hexaboride coated on a substrate surface, the film having a (100) preferred plane.

6. A cathode for a gas discharge display panel according to claim 5, wherein said film has a film thickness within a range from 5,000 Å to 10 μm.

7. A cathode for use in a gas discharge display panel according to claim 5, wherein the full width half maximum of said film in terms of the (100) diffraction rocking curve is 8° or less.

8. A cathode for use in a gas discharge display panel according to claim 5, wherein said rare earth hexaboride is $LaB_6$.

9. A gas discharge display panel according to claim 2, wherein said film of a rare earth hexaboride is a film formed by electron beam evaporation.

10. A gas discharge display panel according to claim 9, wherein the electron beam evaporation is performed using a single crystal source material.

11. A gas discharge display panel according to claim 1, wherein said film of a rare earth hexaboride is a film formed by electron beam evaporation.

12. A gas discharge display panel according to claim 1, wherein said rare earth hexaboride is selected from the group consisting of $CeB_6$, $PrB_6$, $NdB_6$ and $GdB_6$.

13. A cathode for a gas discharge display panel according to claim 5, wherein said rare earth hexaboride is selected from the group consisting of $CeB_6$, $PrB_6$, $NdB_6$ and $GdB_6$.

* * * * *